United States Patent [19]

Gullichsen

[11] Patent Number: 4,780,053

[45] Date of Patent: Oct. 25, 1988

[54] METHOD AND APPARATUS FOR PUMPING FIBER SUSPENSIONS

[76] Inventor: Johan Gullichsen, Siuntion vanha pappila, 02570 Siuntio, Finland

[21] Appl. No.: 848,754

[22] Filed: Apr. 4, 1986

Related U.S. Application Data

[60] Continuation-in-part of Ser. No. 275,756, Jun. 22, 1981, abandoned, which is a continuation-in-part of Ser. No. 79,225, Sep. 26, 1979, abandoned, which is a division of Ser. No. 903,494, May 8, 1978, abandoned.

[30] Foreign Application Priority Data

Apr. 10, 1978 [FI] Finland ..... 781071

[51] Int. Cl.[4] ..... F04D 1/10

[52] U.S. Cl. ..... 415/143

[58] Field of Search ..... 415/121 B, 143; 366/262, 263, 264, 265, 302, 307

[56] References Cited

U.S. PATENT DOCUMENTS

| | | | |
|---|---|---|---|
| 3,961,758 | 6/1976 | Morgan | 415/121 B |
| 4,275,988 | 6/1981 | Kalashnikov et al. | 415/143 |
| 4,435,122 | 3/1984 | Niskanen et al. | 415/121 B |
| 4,476,886 | 10/1984 | Niskanen et al. | 415/219 |
| 4,637,779 | 1/1987 | Sherman et al. | 415/143 |
| 4,650,342 | 3/1987 | Goodwin | 415/143 |

FOREIGN PATENT DOCUMENTS

| | | | |
|---|---|---|---|
| 2411043 | 9/1975 | Fed. Rep. of Germany | 415/121 B |
| 751416 | 9/1933 | France | 415/121 B |
| 960112 | 4/1950 | France | 415/121 B |
| 7901370 | 9/1979 | Netherlands | 415/121 B |
| 985435 | 12/1982 | U.S.S.R. | 415/121 B |
| 268572 | 4/1927 | United Kingdom | 415/121 B |

*Primary Examiner*—Robert E. Garrett
*Assistant Examiner*—John T. Kwon

[57] ABSTRACT

A method and apparatus for pumping fiber suspensions of high consistency. Shear forces disrupting fiber flocs are induced in the front of the impeller in a centrifugal pump which fluidize the fiber suspension thus converting it into an easily pumpable state. This is effected by an inlet part of the pump having rib-shaped lobes in its inner surface in front of the impeller which cooperate with a rotor having an outer surface in which there are lobes. The rotor is disposed in to the outlet part of the vessel during operation.

36 Claims, 4 Drawing Sheets

FIG. 2
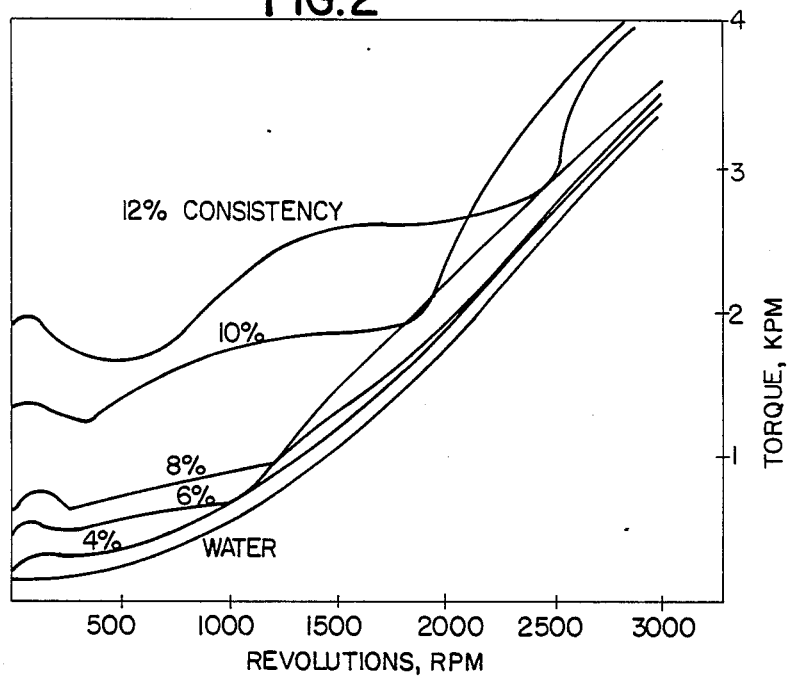
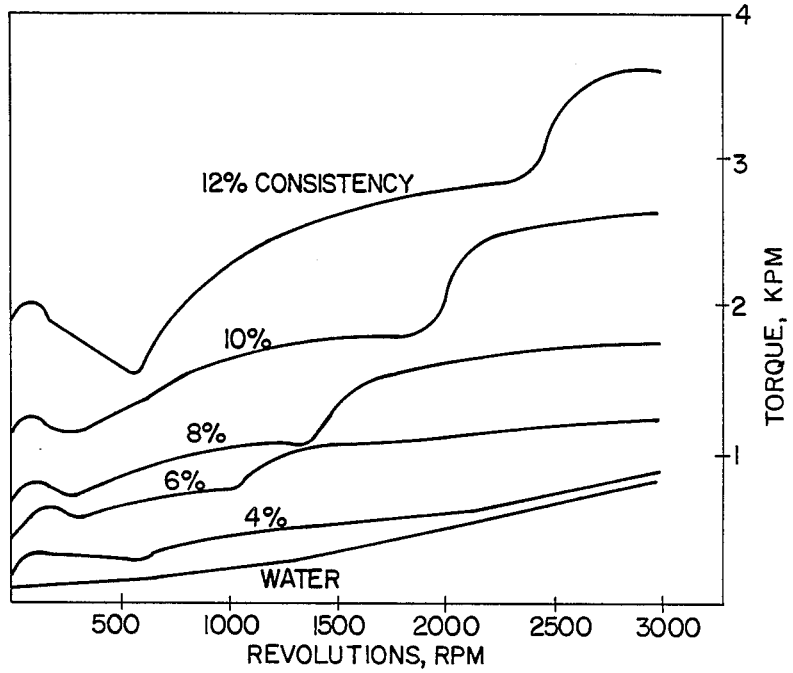
FIG. 3

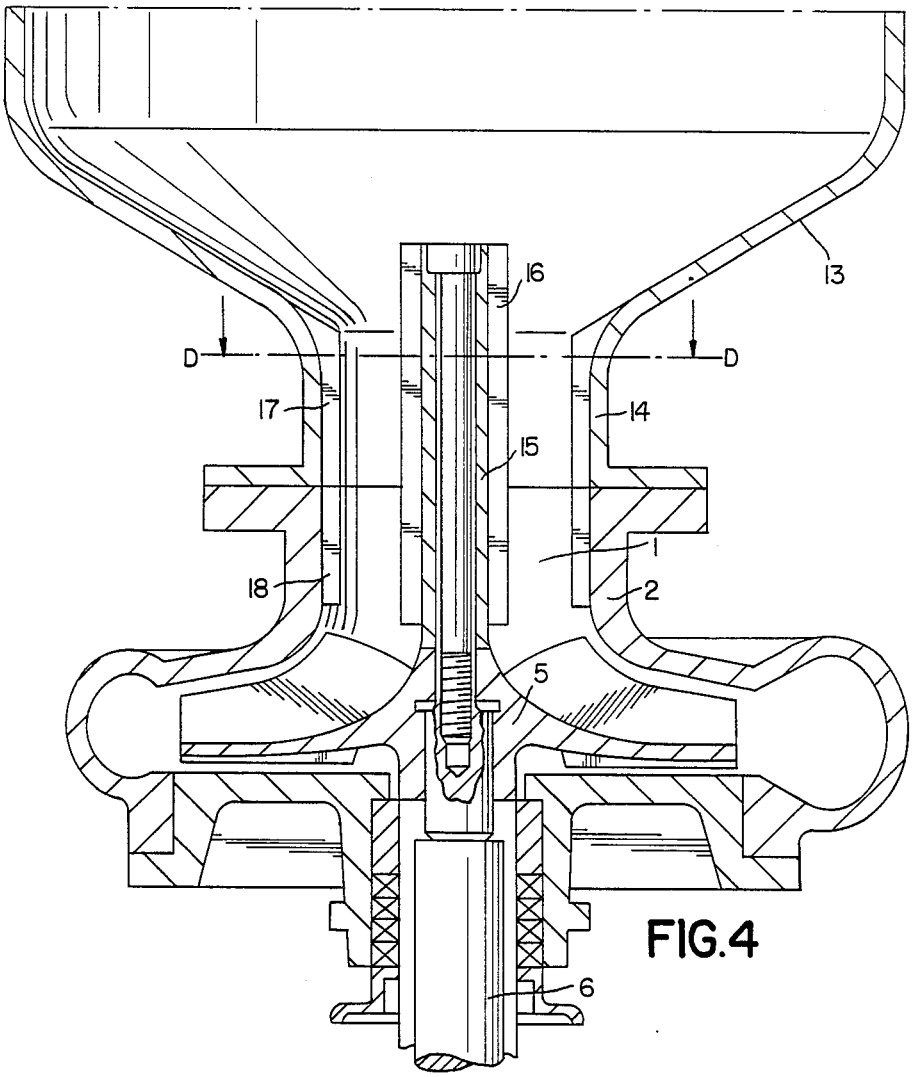
FIG.4
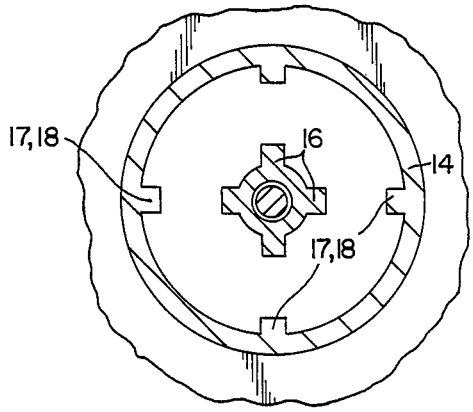
FIG. 5(D-D)

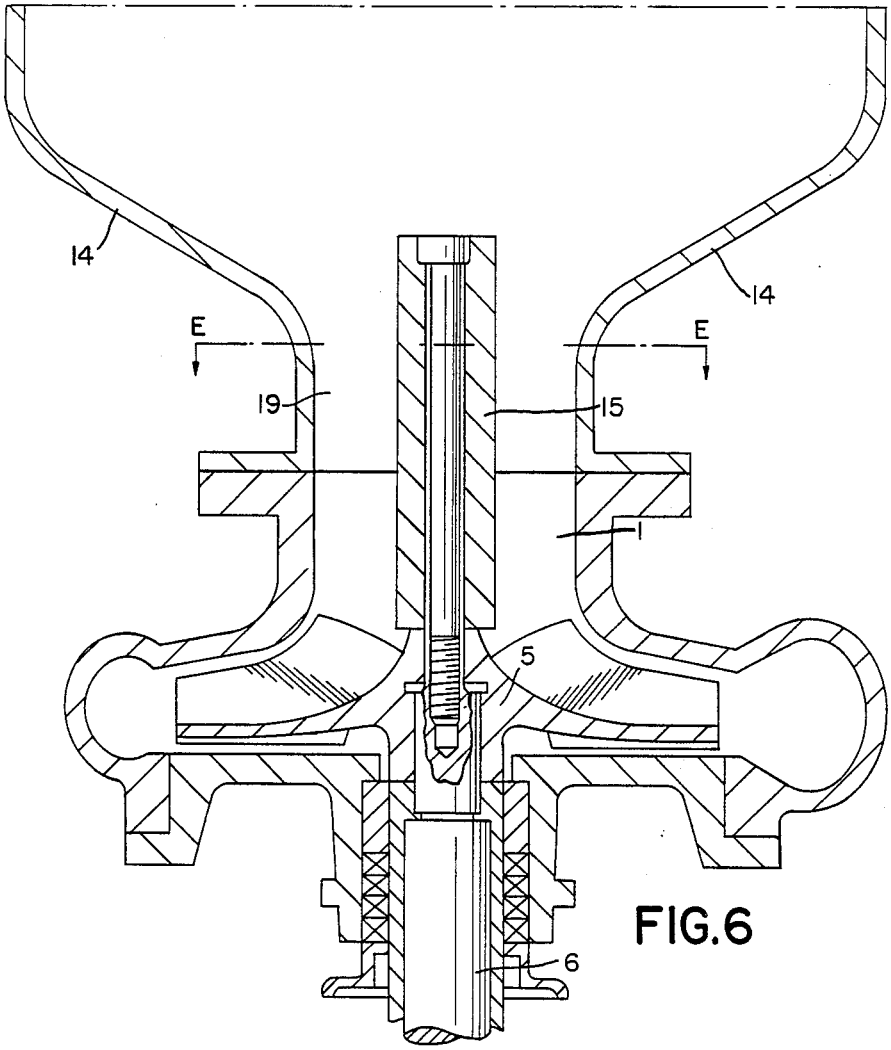
FIG.6
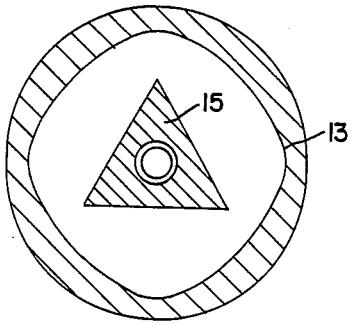
FIG.7 (E-E)

METHOD AND APPARATUS FOR PUMPING FIBER SUSPENSIONS

This application is a Continuation-in-Part of Ser. No. 275,756, filed June 22, 1981, now abandoned, which is a continuation-in-part of Ser. No. 079,225, filed Sept. 26, 1979, now abandoned, which is a division of Ser. No. 903,494, filed May 8, 1978, now abandoned.

TECHNICAL FIELD

The present invention relates in general to a method and an apparatus for pumping fiber suspensions and is particularly intended to be applied to centrifugal pumps for pumping fiber suspensions of high consistency.

BACKGROUND ART

Heretofore centrifugal pumps could successfully be used in the paper and cellulose industry only for pumping fiber suspensions or pulps having consistencies less than 6% provided the pump has been correctly designed and its input pressure is adequately high. A centrifugal pump was not, however, suitable for high consistency pulps because due to flocculation of the pulp, the pump has a tendency to become clogged. Expensive pumps based on the displacement principle must therefore be used for pumping high-consistency pulps.

It should be stressed that in a fiber suspension of consistency above 6%, the fibers tend to form flocs which interlock to form a coherent network which goes through a pipe like a solid, giving plug flow. Most experiments with high consistency pulps have been carried out in an effort to achieve a high degree of agitation and turbulence so that air bubbles are prevented from building up ahead of the impeller inlet. Undoubtedly, this gives some advantages, but agitation requires high energy expenditure.

It is an object of the invention to provide a method and an apparatus for pumping pulps of considerably higher consistencies than heretofore possible by using centrifugal pumps.

Another object of the present invention is to subject the pulp suspension to such shear forces that fluidization is achieved.

DISCLOSURE OF THE INVENTION

The method and apparatus according to the present invention are based on the finding that at a high shear rate, flocs are dislodged from the network and disrupted, so that the pulp is converted into an easily pumpable form because it is fluidized. Fluidization is the state where solid particles can move freely past each other. In a pulp suspension in water, the solid fibers are converted into such a state that the fiber-to-fiber bonds are disrupted and the suspension behaves in a manner similar to a uniform liquid.

The state of fluidization with the apparatus according to the present invention is achieved by subjecting the pulp to shear stresses which disrupt the fiber-to-fiber bonds by causing the pulp to go through a flow passage formed by a non-round rotor having rib-shaped lobes, and the outlet part of the vessel and the inlet part of the pump, the cross-section of which alternately decreases and increases so that flow components directed alternately towards the rotational axis of the rotor and away from it are formed when the rotor rotates. Another feature of the method and apparatus according to the present invention is that the outlet of the pulp vessel is non-round, and is provided with a non-round discontinuous surface. More specifically, the outlet of the pump vessel has recesses or rib-shaped lobes.

According to the invention, fluidization is achieved by generating shear forces in the pump in front of the impeller which disrupt fiber agglomerations or flocs formed in the fiber suspension. The invention is based on the fact that the fiber suspension, when being subjected to forces disrupting fiber-to-fiber bondings, becomes fluidized, i.e. is converted into an easily pumpable state. Compared to a conventional centrifugal pump, a pump according to the invention operates at a lower inlet pressure.

An apparatus according to the invention can e.g. be used for discharging pulps of consistencies from 5% to 25% from pulp vessels and in any event higher than 6%. According to known methods, pulp is discharged from a vessel by mechanical devices such as transport screws or rotating scrapers. Discharge of high-consistency pulps requires much energy and robust constructions. Vibrating devices e.g. based on ultrasonic waves have been suggested to be used for discharging pulps from vessels but in practice these have been proved ineffective. When high-consistency pulps are discharged from large vessels, the pulp is usually diluted in front of the outlet in order to make it flow out.

According to the invention, the pump is disposed into the outlet of the pulp vessel so that a rotor running through the inlet part of the pump and the outlet of the pulp vessel, extends into the vessel so that it fluidizes the pulp and the pulp can flow into the pump underneath due to gravitational forces.

Another feature of the present invention resides in providing a rotor with ribs while the outlet of the pulp vessel may have recesses or ribs.

BRIEF DESCRIPTION OF THE DRAWINGS

The invention is described in more detail below with reference to the appended drawings in which:

FIG. 2 is a plot of torques on the ordinate and rotational speeds on the abscissa in experiments according to the present invention with the apparatus according to FIG. 1.

FIG. 3 is a plot of torques on the ordinate and rotational speed on the abscissa in experiments with an apparatus having a rotor without ribs, not in accordance with the invention, for comparison purposes.

FIG. 4 shows a vertical sectional view of the embodiment of the apparatus according to the invention illustrated in FIG. 1. The apparatus of FIG. 1 is a cross-section of the apparatus taken along the line D-D of FIG. 4.

FIG. 5 shows another cross-section.

FIGS. 6 and 7 show another embodiment of the apparatus of this invention.

DESCRIPTION OF A PREFERRED EMBODIMENT OF THE INVENTION

Figure 1:
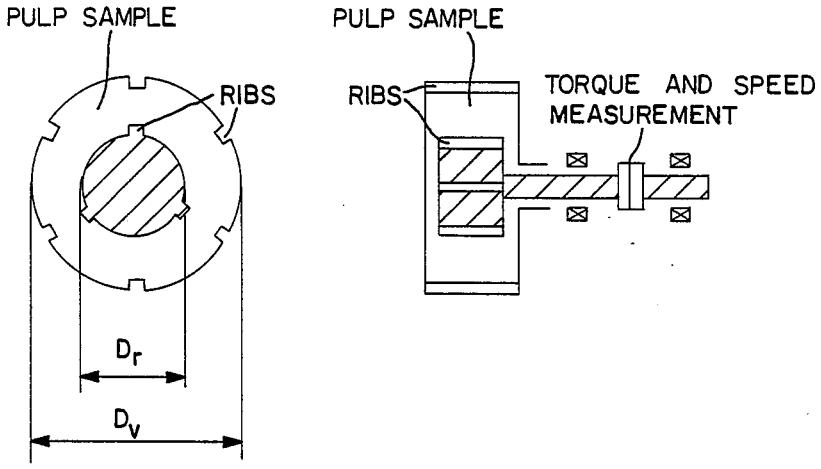
FIG. 1 illustrates an apparatus according to the present invention used to make torque measurements. The apparatus comprises a container provided with a rotor having external ribs.

FIGS. 4 and 5 show an embodiment of the invention where numeral 1 refers to the pump housing and the inlet part 2 of the pump is connected to the outlet 14 of the pulp vessel 13, in order to remove pulp from the vessel. A rotor 15 running through the inlet part of the pump and the outlet 14 of the pulp vessel 13 has been mounted on the same shaft 6 as the impeller 5. The rotor is provided with rib-shaped lobes 16 and the outlet of the pulp vessel is provided with rib-shaped lobes 17, the main direction of which is axial. Rib-shaped lobes 18 are provided at the inlet part 2 of the pump.

If necessary the pulp vessel may be provided with several outlets each of which is connected to a pump.

According to one embodiment, the rotor in front of the impeller can rotate at a different angular speed than the impeller 5.

In the fiber suspension flow components alternate in direction and deviate from the main flow direction so that shear forces are generated disrupting the fiber-to-fiber bondings as the width of the flow passage between the rotor and the outlet part of the vessel and the inlet part of the pump alternately increases and decreases when the rotor rotates. The result is that the fiber suspension becomes fluidized and its flow resistance decreases.

While the rotor rotates, the fiber suspension in front of the outlet of the vessel is also subjected to shear forces by the part of the rotor extending into the vessel. Therefore, the fiber suspension becomes fluidized just in front of the outlet and flow unhindered from the vessel to the impeller.

EXAMPLE 1

A device according to FIG. 1 was used which comprises a rotor provided with ribs. The rotor was disposed in the pulp container. The rotor was mounted on a shaft extending through the wall of the container. Means for measuring the torque and the rotational speed of the shaft were provided. The end plate of the container was transparent to allow visual observation. Detailed motional patterns could be studied by coloring the liquid.

Two series of tests were carried out with the container filled by pulp having a consistency of 4, 6, 8, 10 and 12%, one using a container provided with internal ribs and one without ribs. Comparative tests were carried out with the container filled with water. A shear stress field was generated between the rotor and the container wall by rotating the rotor. The torque versus the rotational speed was recorded for the container having internal ribs (FIG. 2) and for the container without ribs (FIG. 3).

The rotor diameter $D_r$ was 100 mm., the container diameter $D_v$ 213 mm. and the height of the ribs was 10 mm.

As shown in FIG. 2, in the container having internal ribs, the torque (shear stress) rapidly increased. When a transition point just prior to fiber-network disruption was reached, high shear stress ratios are generated at relatively low rotational speeds. In the container without ribs, much higher rotational speeds were needed in order to bring about the same shear stress ratios.

To disrupt the fiber-network, i.e. to fluidize the pulp, a shear stress exceeding a critical value which depends on the consistency and the pulp quality has to be brought about. In a vessel having internal ribs fully developed fluidization may therefore be achieved by using less power than in a container without ribs.

FIG. 3 shows the fact that fiber network disruption could not be reached without the ribs on the container wall with available rotor speeds, since the curves for fiber suspensions did not approach the water curve as in FIG. 2.

EXAMPLE 2

The apparatus of FIGS. 4 and 5 was used. A pump essentially as presented in FIGS. 4 and 5 was installed vertically at the bottom of a fullscale down-flow storage tower and stock was discharged and pumped further at 12% consistency without prior dilution against a considerable pressure. The following data were measured:

| | | Range |
|---|---|---|
| Flow | l/min | 500–7500 |
| Consistency | % | 11–12 |
| Production | tadp/d | 100–1400 |
| Pump Head | bar | 6.0–7.0 |
| Level in tank | m | 2–16 |

These results clearly demonstrate the operability of the apparatus of this invention.

In the embodiment of FIGS. 6 and 7, numeral 14 is the wall of the outlet duct of the vessel. Numeral 19 is the outlet itself, that is the space surrounded by the wall 14. Rotor 15 has a triangular cross-section and is mounted in front of impeller 5. The rotor is placed in the outlet 19. The outlet has a quadrangular, slightly curved cross-section. Also in this embodiment, the cross-section of the duct through which the pulp flows, alternately decreases and increases in the direction of rotation so that shear forces are generated and the pulp is fluidized. To state the matter in different words, the rotational motion of pulp has alternate flow components towards and away from the rotational axis of the rotor.

What is claimed is:

1. A method for fluidizing a high consistency fiber suspension having a consistency of from about 8 to about 20% of fiber and stored in a vessel having an outlet and for pumping said fiber suspension in the fluidized state by a centrifugal pump including a housing having an inlet, an impeller disposed in said housing, and a non-circular rotor mounted for rotation within said said housing inlet, said method comprising the following steps:

(a) connecting said pump housing inlet to said vessel outlet;

(b) rotating said rotor at a speed sufficient to generate a shear force field within said suspension, said shear force field being generated in said pump housing inlet and in said vessel and being of sufficient strength to fluidize said suspension in said housing inlet and said vessel adjacent said housing inlet;

(c) rotating said impeller; and (d) discharging said fluidized suspension from said pump.

2. The method of claim 1, wherein said non-circularity of said rotor is imparted by the inclusion of rib-shaped lobes.

3. The method of claim 1, wherein the pump housing inlet includes rib-shaped lobes.

4. The method of claim 1, wherein said non-circularity of said rotor is imparted by the inclusion of rib-shaped lobes and said pump housing inlet includes rib-shaped lobes for generating said shear force field.

5. The method of claim 1, wherein said non-circular rotor extends through said inlet into said vessel.

6. The method of claim 1, wherein said rotor is located adjacent said impeller.

7. A centrifugal pump for fluidizing a high consistency fiber suspension stored in a vessel having an outlet and for pumping the fiber suspension having a consistency of from about 8 to about 20% fiber in the fluidized state, said pump comprising:

(a) a pump housing having an inlet connectable with said vessel outlet;

(b) an impeller mounted within said housing for discharging said fluidized suspension;

(c) a shaft operatively connected to said impeller;

(d) a non-circular rotor mounted for rotation within said inlet for generating a shear force field of sufficient strength to fluidize said suspension in said housing inlet and in said vessel adjacent said pump housing inlet.

8. The pump of claim 7, wherein said non-circularity of said rotor is imparted by the inclusion of rib-shaped lobes.

9. The pump of claim 7, wherein said pump housing inlet includes rib-shaped lobes.

10. The pump of claim 7, wherein said non-circularity of said rotor is imparted by the inclusion of rib-shaped lobes and said housing inlet includes rib-shaped lobes for generating said shear force field.

11. The pump of claim 7, wherein said non-circular rotor extends through said pump housing inlet into said vessel.

12. The pump of claim 11, wherein said non-circularity of said rotor is imparted by the inclusion of rib-shaped lobes.

13. The pump of claim 12, wherein said pump housing inlet includes rib-shaped lobes.

14. The pump of claim 7, wherein said non-circular rotor is mounted on the same shaft as said impeller.

15. The pump of claim 7, wherein said rotor is located adjacent said impeller.

16. In combination a vessel for holding a fiber suspension having a consistency of from about 8 to about 20% fiber and a centrifugal pump for fluidizing and pumping the fiber suspension therefrom comprising:

(a) a vessel outlet;

(b) a pump housing having a suspension inlet part connected to said vessel outlet for allowing said suspension to pass into said housing;

(c) said housing further having a suspension outlet;

(d) an impeller mounted within said housing for discharging said suspension through said housing outlet;

(e) a shaft operatively connected to said impeller;

(f) a non-circular rotor mounted for rotation within said inlet part for generating a shear force field of sufficient strength to fluidize said suspension in said inlet part and in said vessel adjacent said vessel outlet.

17. The combination of claim 16, wherein said non-circularity of said rotor is imparted by the inclusion of rib-shaped lobes.

18. The combination of claim 16, wherein said inlet includes rib-shaped lobes.

19. The combination of claim 16, wherein said non-circularity of said rotor is imparted by the inclusion of rib-shaped lobes and said inlet includes rib-shaped lobes for generating said shear force field.

20. The combination of claim 16 wherein said vessel outlet includes rib-shaped lobes.

21. The combination of claim 16, wherein said non-circular rotor extends through said inlet part into said vessel.

22. The combination of claim 21, wherein said non-circularity of said rotor is imparted by the inclusion of rib-shaped lobes.

23. The combination of claim 22, wherein said inlet part includes rib-shaped lobes.

24. The combination of claim 23, wherein said vessel outlet includes rib-shaped lobes.

25. The combination of claim 16, wherein said non-circular rotor is mounted on the same shaft as said impeller.

26. The combination of claim 16, wherein said rotor is located adjacent said impeller.

27. The pump of claim 26, wherein said non-circular rotor is mounted on the same shaft as said impeller.

28. The pump of claim 26, wherein said rotor is located adjacent said impeller.

29. A centrifugal pump for fluidizing a high consistency fiber suspension having a consistency of from about 8 to about 20% fiber stored in a vessel having an outlet and for pumping said fiber suspension in the fluidized state, said pump comprising:

(a) a pump housing having an inlet connectable with said vessel outlet;

(b) an impeller disposed within said housing for discharging said fluidized suspension;

(c) a shaft operatively connected to said impeller;

(d) a non-circular rotor mounted for rotation within said pump housing inlet;

(e) said inlet and said rotor defining and being spaced apart by a space, at least one of the surfaces defining said space being non-circular for generating a shear force field, said shear force field extending through said pump housing inlet into said vessel adjacent said inlet and being of sufficient strength to disrupt the fiber-to-fiber bonds of said fiber suspension for fluidizing said suspension and rendering said suspension pumpable.

30. The pump of claim 29, wherein said non-circularity of said rotor is imparted by the inclusion of rib-shaped lobes.

31. The pump of claim 29, wherein said pump inlet includes rib-shaped lobes.

32. The pump of claim 29, wherein said non-circularity of said rotor is imparted by the inclusion of rib-shaped lobes and said pump inlet includes rib-shaped lobes for generating said shear force field.

33. The pump of claim 29, wherein said non-circular rotor extends through said pump inlet into said vessel.

34. The pump of claim 33, wherein said non-circularity of said rotor is imparted by the inclusion of rib-shaped lobes.

35. The pump of claim 34, wherein said inlet includes rib-shaped lobes.

36. The pump of claim 33, wherein said non-circularity of said rotor is imparted by the inclusion of rib-shaped lobes and said inlet includes rib-shaped lobes.

* * * * *

UNITED STATES PATENT AND TRADEMARK OFFICE

CERTIFICATE OF CORRECTION

PATENT NO. : 4,780,053

DATED : October 25, 1988

INVENTOR(S) : Johan Gullichsen

It is certified that error appears in the above-identified patent and that said Letters Patent is hereby corrected as shown below:

On the title page Insert

--(73) Assignee: A. Ahlstrom Corporation,
Karhula, Finland--.

Signed and Sealed this

Fourth Day of July, 1989

*Attest:*

*Attesting Officer*

DONALD J. QUIGG

*Commissioner of Patents and Trademarks*